US005569141A

United States Patent [19]

Chou

[11] Patent Number: 5,569,141

[45] Date of Patent: Oct. 29, 1996

[54] INVERSION PRACTICE EXERCISER

[76] Inventor: Chen-chang Chou, No. 9, Chingchuan Rd., Taya Hsiang, Taichung Hsien, Taiwan

[21] Appl. No.: 552,721

[22] Filed: Nov. 3, 1995

[51] Int. Cl.[6] ..... A63B 23/00

[52] U.S. Cl. ..... 482/144; 482/38; 482/40; 482/148

[58] Field of Search ..... 482/38, 40, 142, 482/144, 34–38, 148; D21/191–196

[56] References Cited

U.S. PATENT DOCUMENTS

| | | | |
|---|---|---|---|
| D. 333,329 | 2/1993 | Jacobs | D21/191 |
| 2,673,737 | 3/1954 | Daniels . | |
| 3,114,545 | 12/1963 | Horn | 482/144 |
| 3,679,203 | 7/1972 | Grana | 482/144 |
| 4,789,152 | 12/1988 | Guerra | 482/41 |
| 5,221,246 | 6/1993 | Torlii | 482/121 |

*Primary Examiner*—Jerome Donnelly
*Attorney, Agent, or Firm*—Hedman, Gibson & Costigan, P.C.

[57] ABSTRACT

An inversion practice exerciser includes a base member including a horizontal beam and two side beams each attached to one distal end of the horizontal beam. A pair of handgrip members are each mounted on a corresponding one of the two side beams. A pair of upright members are mounted on the base member and each includes a lower post and an upper post pivotally engaged with each other. A pair of shoulder supporting members are each mounted on a corresponding one of the two upper posts and each have a buffer pad mounted thereon. A pair of buffer pads are mounted around an upper end portion of a corresponding one of the two upper posts.

3 Claims, 5 Drawing Sheets

INVERSION PRACTICE EXERCISER

BACKGROUND OF THE INVENTION

1. Field of Invention

The present invention relates to an exerciser, and more particularly to an inversion practice exerciser.

2. Background of the Invention

The present invention has arisen to increase functions of the conventional inversion practice exerciser.

SUMMARY OF THE INVENTION

The primary objective of the present invention is to provide an inversion practice exerciser for a user who can thereby practice a skill of standing upside down.

In accordance with one aspect of the present invention, there is provided an inversion practice exerciser comprising a base member including a horizontal beam having two distal ends and two side beams each attached to a corresponding one of the two distal ends of the horizontal beam. A pair of handgrip members each have a first distal end fixedly mounted on a corresponding one of the two side beams and a second distal end supported on the ground.

A pair of upright members are vertically mounted on the base member and each include a lower post having a lower end portion slidably mounted on the horizontal beam and an upper end portion, and an upper post having a lower end portion pivotally engaged with the upper end portion of the lower post and an upper end portion.

A pair of shoulder supporting members are each laterally and fixedly mounted on a corresponding one of the two upper posts and each have a first buffer pad mounted thereon in a horizontal manner.

A pair of second buffer pads are each mounted on the upper end portion of a corresponding one of the two upper posts.

Further objectives and advantages of the present invention will become apparent from a careful reading of the detailed description provided hereinblow, with appropriate reference to the accompanying drawings.

DETAILED DESCRIPTION OF THE PREFERRED EMBODIMENTS

Figure 1:
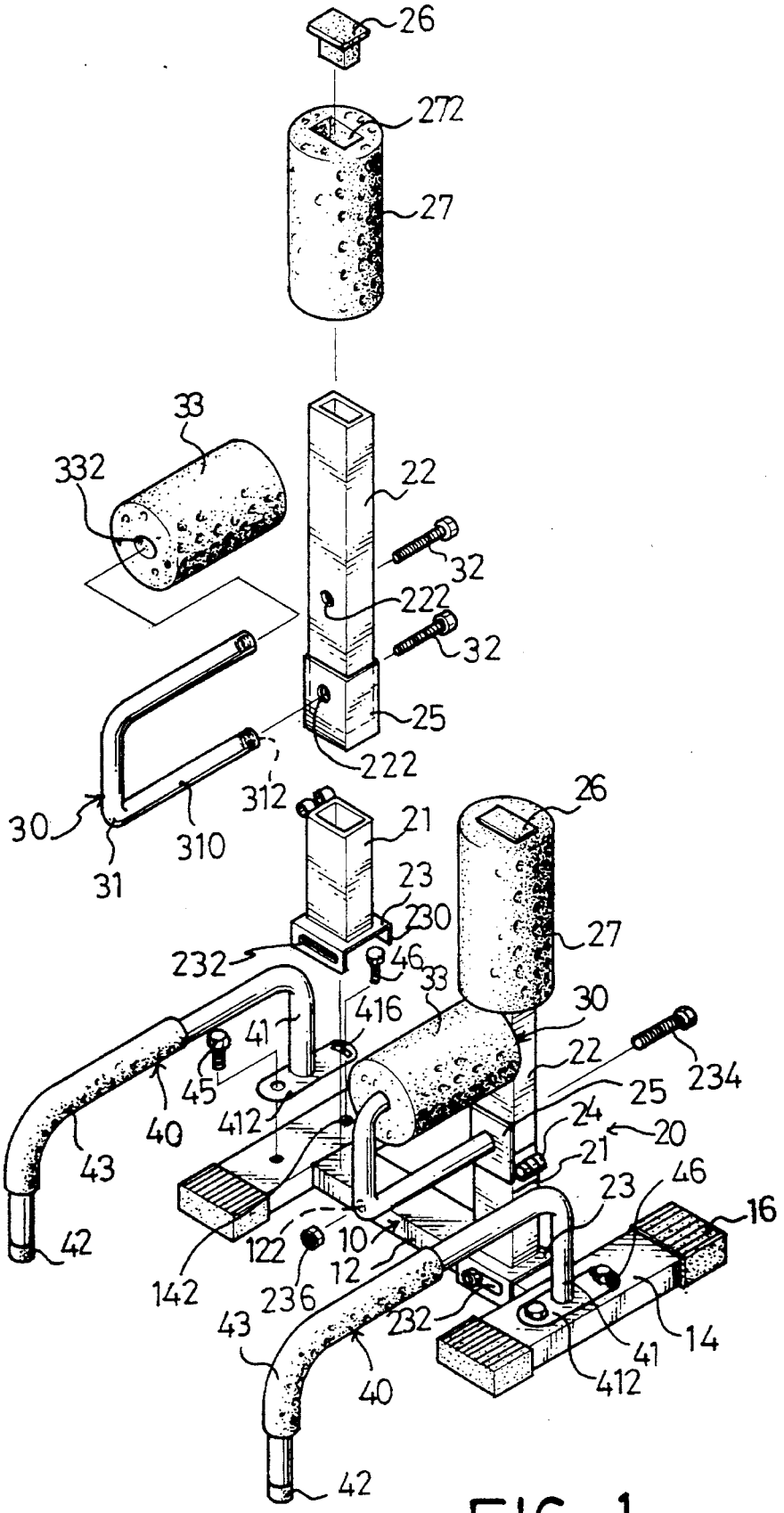
FIG. 1 is a partially exploded view of an inversion practice exerciser in accordance with the present invention.

Referring to the drawings, and initially to FIG. 1, an inversion practice exerciser in accordance with the present invention is provided for a user, such as a gymnast, to practice a skill of standing upside down. In other words, the user can invert his/her body with the assistance of the inversion practice exerciser.

The inversion practice exerciser in accordance with the present invention comprises a substantially H-shaped base member 10 mounted on the ground. The base member 10 includes a horizontal beam 12 having two distal ends, and two parallel side beams 14 each attached to a corresponding one of the two distal ends of the horizontal beam 12.

Preferably, each of the two side beams 14 has two distal ends on which an end cap 16 is mounted.

There are a pair of handgrip members 40 substantially inverted U-shaped in section each having a first distal end 41 fixedly mounted on a corresponding one of the two side beams 14 and each having a second distal end 42 supported on the ground. Preferably, each of the two handgrip members 40 includes an elongated handgrip pad 43 mounted around a horizontal portion thereof and includes a flat sheet 412 formed on the first distal end 41 thereof and fixedly attached to the associated side beam 14 by means of a positioning bolt 45.

Preferably, there are a pair of adjusting bolts 46 each extending through an arcuate slot 416 defined in each of the two flat sheets 412 and each threadedly engaged in a threaded bore 142 defined in each of the two side beams 14 such that a relative angle between each of the two handgrip members 40 and the associated side beam 14 can be adjusted freely.

Referring to FIGS. 1–4, a pair of upright members 20 are vertically mounted on the base member 10 and each include a lower post 21 having a lower end portion slidably mounted on the horizontal beam 12 and an upper end portion, and an upper post 22 having a lower end portion pivotally engaged with the upper end portion of the lower post 21 by means of a hinge member 24 and having an upper end portion.

Figure 4:
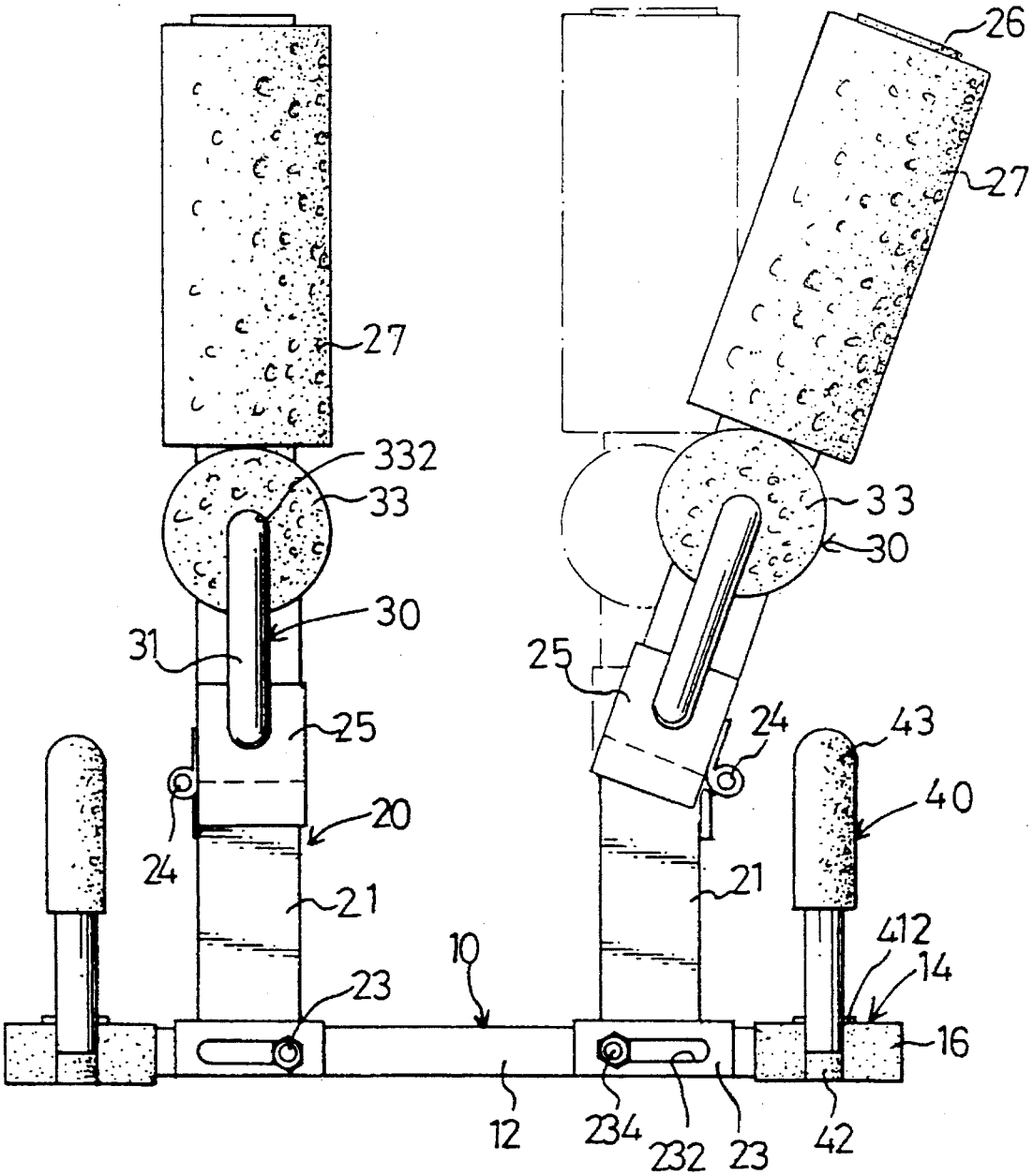
FIG. 4 is an operational view of FIG. 3.

A pair of retaining brackets 25 are each mounted around an engaging portion defined between the lower end portion of a corresponding one of the two upper posts 22 and the upper end portion of the associated lower post 21 for facilitating pivotal movement between each of the two upper posts 22 and the associated lower post 21 about the hinge member 24 as shown in FIG. 4.

There are a pair of shoulder supporting members 30 each laterally and fixedly mounted on a corresponding one of the two upper posts 22 and each having a first buffer pad 33 mounted thereon in a horizontal manner. Preferably, each of the pair of shoulder supporting members 30 comprises a substantially U-shaped frame 31 including two horizontal rods 310 each having a threaded hole 312 defined in a free end thereof. In addition, each of the two first buffer pads 33 has an axial hole 332 longitudinally defined therethrough for receiving an upper horizontal rod 310 of the U-shaped frame 31 of the associated shoulder supporting member 30.

Each of the two upper posts 22 includes two holes 222 transversely defined therethrough and communicating with a corresponding one of the two threaded holes 312. One of the two holes 222 is also defined through the associated retaining bracket 25.

Figure 2:
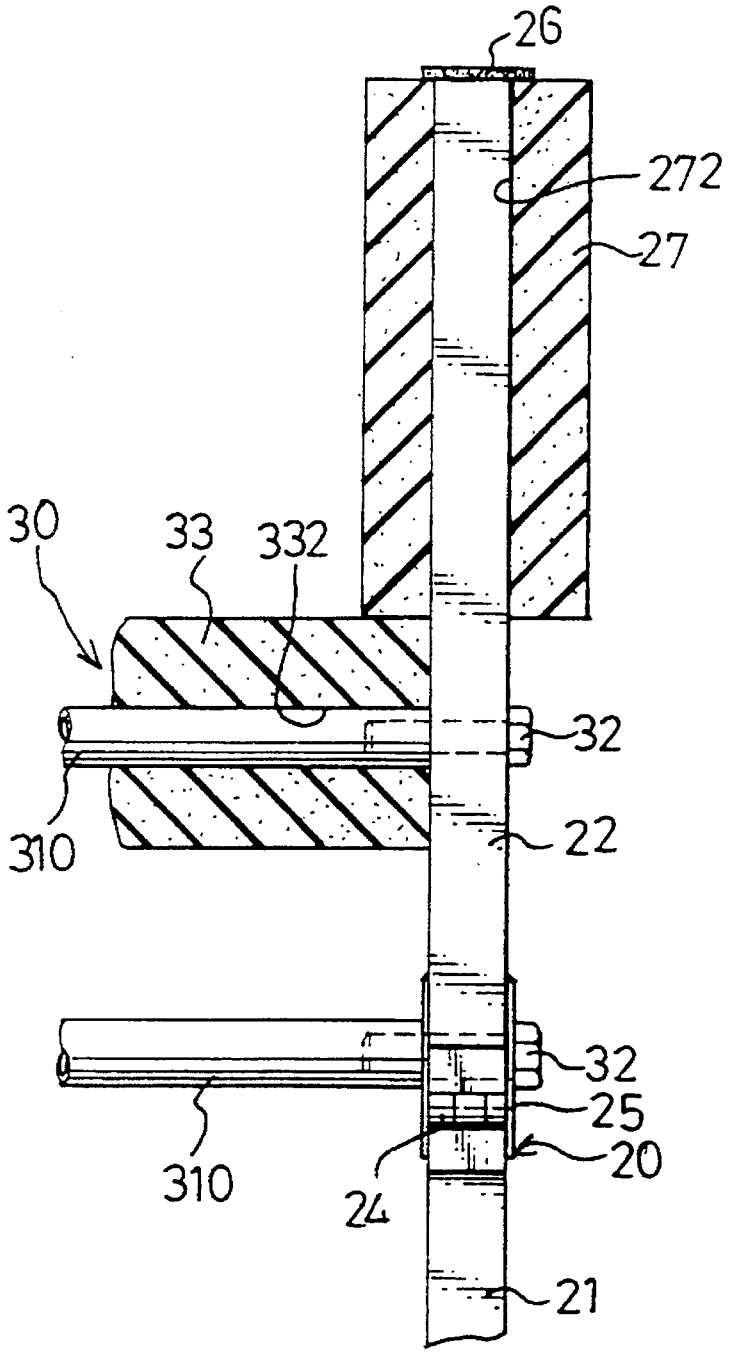
FIG. 2 is a partially side cross-sectional view of FIG. 1.

There are two pairs of positioning bolts 32, each pair respectively extending through the two holes 222 of a corresponding one of the two upper posts 22 and each pair threadedly engaged in the associated two threaded holes 312, thereby fastening each of the two shoulder supporting members 30 to the associated upper post 22 as shown in FIG. 2.

A pair of second buffer pads 27 are each mounted on the upper end portion of a corresponding one of the two upper posts 22. Preferably, each of the two second buffer pads 27 includes a rectangular passage 272 longitudinally defined therethrough for receiving the upper end portion of the associated upper post 22 therein. A pair of end plugs 26 are each fitted on a corresponding one of the two second buffer pads 27.

Figure 3:
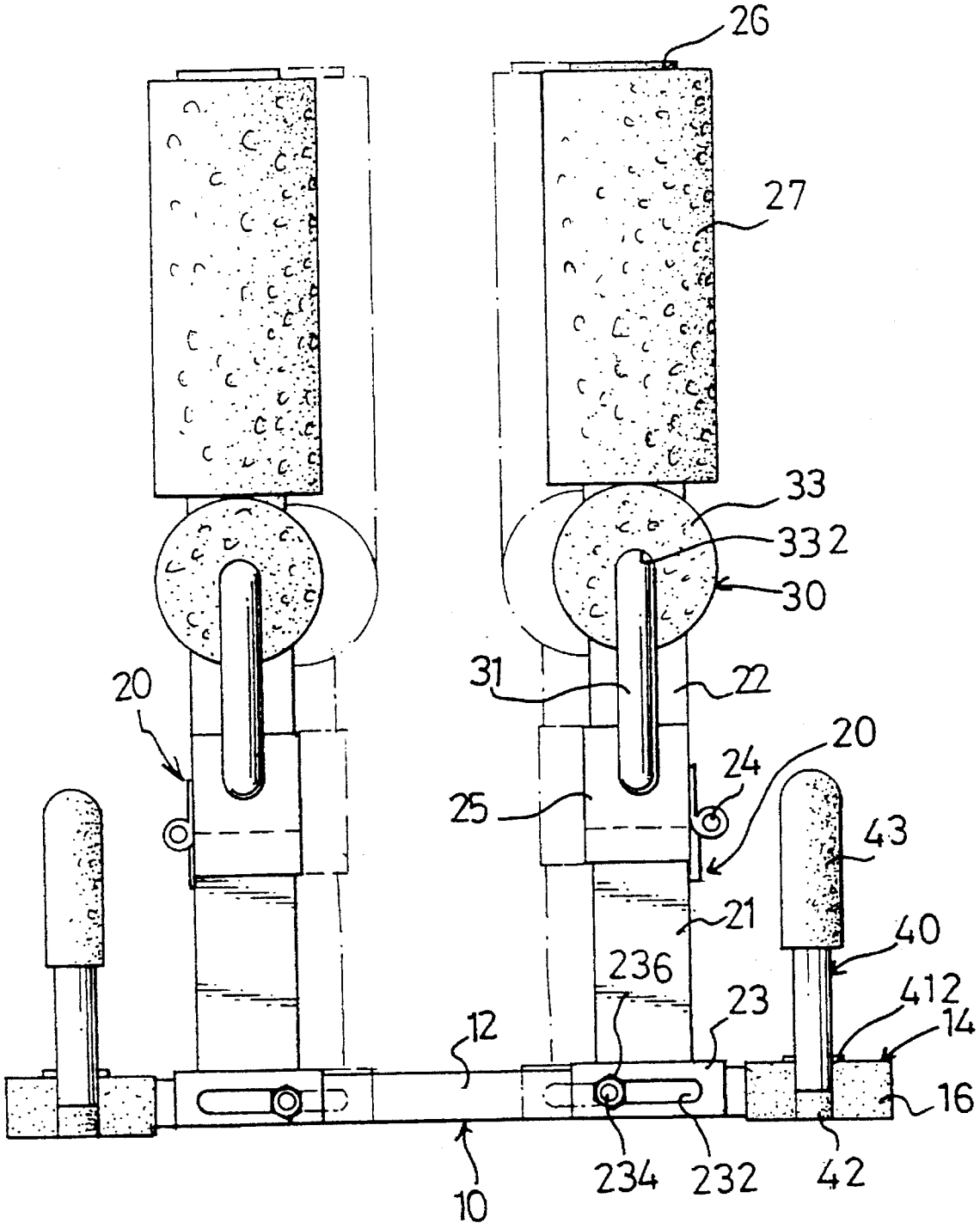
FIG. 3 is a front plan assembly view of FIG. 1.

Referring to FIGS. 1 and 3, the horizontal beam 12 has two opposite sides and has two holes 122 transversely defined therethrough. Each of the two lower posts 21 includes a substantially inverted U-shaped frame 23 formed on the lower end portion thereof and having two side plates 230 each slidably rested on a corresponding one of the two opposite sides of the horizontal beams 12 and each having an elongated slot 232 horizontally defined therethrough and communicating with a corresponding one of the two holes 122.

A pair of positioning bolts 234 each extend through the two elongated slots 232 of a corresponding one of the two inverted U-shaped frames 23 and through the associated hole 122 of the horizontal beam 12 and are each threadedly engaged with a corresponding one of two positioning nuts 236, thereby positioning each of the two lower posts 21 on the horizontal beam 12.

Preferably, each of the two lower posts 21 is able to slide on the horizontal beam 12 when the associated positioning bolt and nut 234 and 236 are unscrewed, thereby adjusting the distance defined between the two shoulder supporting members 30 and the distance defined between the two second buffer pads 27.

Figure 5:
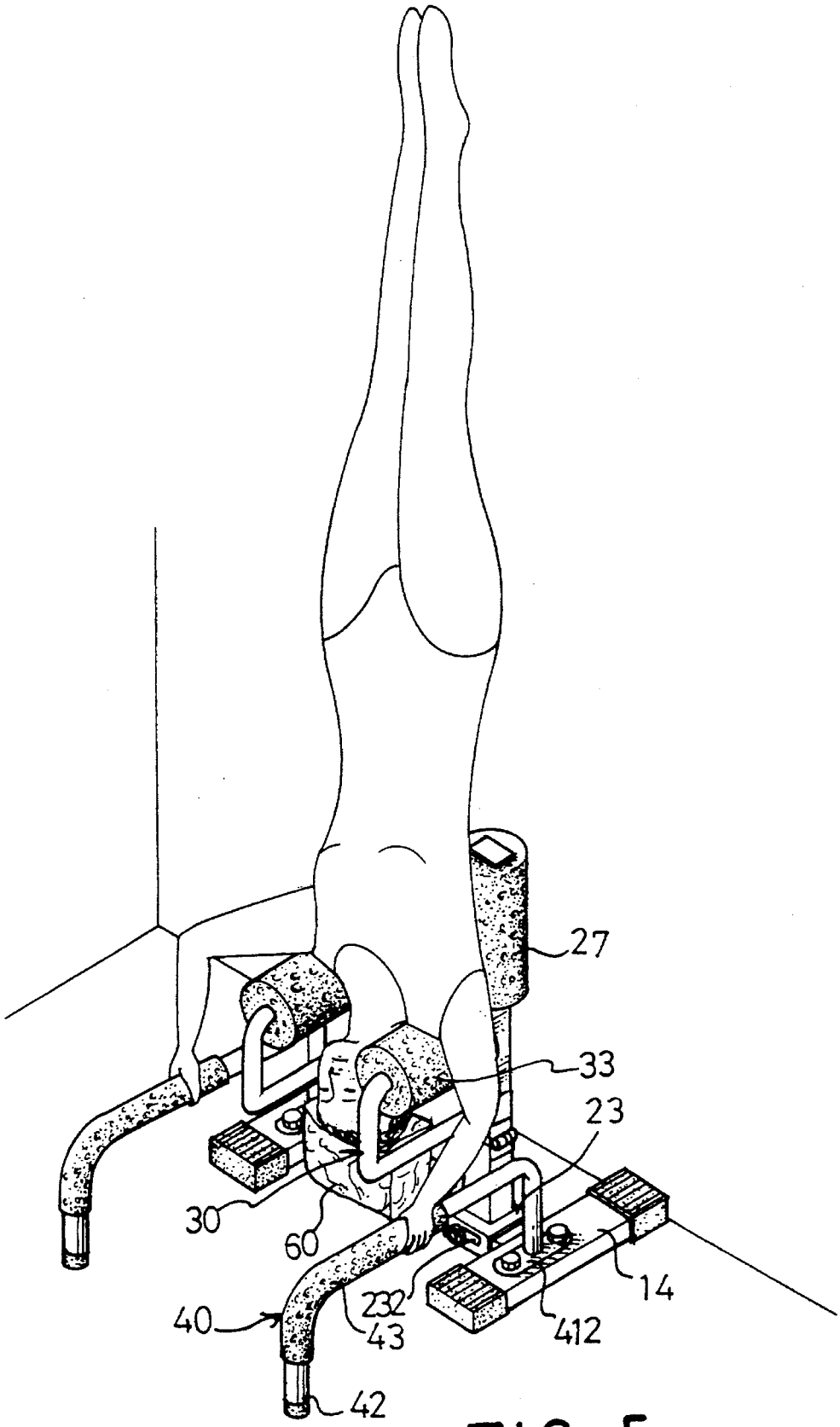
FIG. 5 is an operational view of the present invention.

In operation, referring to FIG. 5 with reference to FIG. 1, the user can invert his/her body with his/her two hands each gripping the handgrip pad 43 of a corresponding one of the two handgrip members 40 respectively and his/her two legs rested on the vertical wall. In the meantime, the user's two shoulders are respectively supported on the two buffer pads 33 of the pair of shoulder supporting members 30 and the his/her back is rested on the two second buffer pads 27. Preferably, a cushion pad 60 is disposed on the ground and located below the head of the user. By such an arrangement, the user will be able to practice the skill of standing upside down.

Preferably, each of the two upper posts 22 are able to pivot relative to the associated lower post 21, so, the shoulder supporting members 30 and second buffer pads 27 are able to pivot therewith relative to the base member 10 when the user is disposed in a slightly slanted fashion due to his/her body's unbalance, thereby preventing the shoulder supporting members 30 from injuring the user's neck.

It should be clear to those skilled in the art that further embodiments of the present invention may be made without departing from the teachings of the present invention.

What is claimed is:

1. An inversion practice exerciser comprising:

a base member (10) including a horizontal beam (12) having two distal ends, and two side beams (14) each attached to a corresponding one of the two distal ends of said horizontal beam (12);

a pair of handgrip members (40) substantially inverted U-shaped in section each having a first distal end (41) fixedly mounted on a corresponding one of said two side beams (14) and a second distal end (42) supported on the ground;

a pair of upright members (20) vertically mounted on said base member (10) and each including a lower post (21) having a lower end portion slidably mounted on said horizontal beam (12) and an upper end portion, and an upper post (22) having a lower end portion pivotally engaged with the upper end portion of said lower post (21) and an upper end portion;

a pair of shoulder supporting members (30) each laterally and fixedly mounted on a corresponding one of the two upper posts (22) and each having a first buffer pad (33) mounted thereon in a horizontal manner; and a pair of second buffer pad (27) each mounted on a corresponding one of the two upper posts (22).

2. The inversion practice exerciser in accordance with claim 1, further comprising a pair of retaining members (25) each mounted around an engaging portion defined between the lower end portion of a corresponding one of said two upper posts (22) and the upper end portion of associated said lower posts (21) for facilitating pivotal movement between each of said two upper posts (22) and associated said lower posts (21).

3. The inversion practice exerciser in accordance with claim 1, wherein said horizontal beam (12) has two opposite sides, two holes (122) are transversely defined though said horizontal beam (12), each of said two lower posts (21) includes a substantially inverted U-shaped frame (23) formed on the lower end portion thereof and having two side plates (230) each slidably rested on a corresponding one of the two opposite sides of said horizontal beam (12) and each having an elongated slot (232) horizontally defined therethrough and communicating with a corresponding one of the two holes (122), a pair of positioning bolts (234) each extending through said two elongated slots (232) of a 19 corresponding one of said two inverted U-shaped frames (23) and through associated said holes (122) of said horizontal beam (12) and each threadedly engaged with a corresponding one of two positioning nuts (236), thereby positioning each of said two lower posts (21) on said horizontal beam (12).

* * * * *